United States Patent [19]

Schmitman et al.

[11] 3,991,314

[45] Nov. 9, 1976

[54] X-RAY DIAGNOSIS APPARATUS FOR X-RAYING AND EXPOSURE

[75] Inventors: Herbert Schmitman, Erlangen; Hans-Werner Winkler, Buckenhof; Georg Schäfer, Erlangen, all of Germany

[73] Assignee: Siemens Aktiengesellschaft, Munich, Germany

[22] Filed: Sept. 6, 1973

[21] Appl. No.: 394,887

[30] Foreign Application Priority Data

Sept. 19, 1973 Germany ..... 2245939

[52] U.S. Cl. ..... 250/402; 250/409; 250/413

[51] Int. Cl.[2] ..... H05G 1/30

[58] Field of Search ..... 250/322, 401, 402, 408, 250/409, 410, 411, 413, 414, 415

[56] References Cited

UNITED STATES PATENTS 3,546,461 12/1970 Craig ..... 250/322

3,548,208 12/1970 Battista ..... 250/410

3,585,391 6/1971 Siedband et al. ..... 250/409

*Primary Examiner*—Craig E. Church

*Attorney, Agent, or Firm*—Richards & Geier

[57] ABSTRACT

An X-ray diagnosis apparatus for fluoroscopy and exposure includes an image-intensifier-television chain, a device for controlling the dose rate during X-raying, means fixing the exposure data from X-raying data and an automatic exposure timer. The invention is particularly characterized by the provision of a function generator which receives a signal corresponding to the X-raying voltage and produces therefrom an output signal operating the setting means for the exposure voltage, and wherein is programmed the shape of the photographing voltage depending upon the X-raying voltage.

3 Claims, 5 Drawing Figures

X-RAY DIAGNOSIS APPARATUS FOR X-RAYING AND EXPOSURE

This invention relates to an X-ray diagnosis apparatus for fluoroscopy and exposure having an image-intensifier-television chain, a device for controlling the dose output during X-raying, and an automatic exposure timer.

An X-ray diagnosis apparatus of this type is known, wherein the X-raying voltage which is set by the dose rate control device is taken over during exposure as the exposure voltage. The dose rate control device causes the change in the X-ray tube voltage and the X-ray tube current depending upon a predetermined function so as to control the dose rate output and the brightness at the output of the image intensifier. However, the actual X-raying voltage is not always the best exposure voltage since in addition to the transparency of the patient it also depends upon other factors, such as, for example, the body part or organ to be photographed, the desired exposure time period and the desired contrast. Thus while the known X-ray diagnosis apparatus is simple in its operation, since no exposure voltage is to be set, it does not always produce the best exposure requirements.

An object of the present invention is to provide an X-ray diagnosis apparatus of the described type, namely, an X-ray diagnosis apparatus wherein in principle the setting of exposure voltage for each individual exposure or for a series of exposures is not required, but wherein it is possible to act upon the voltage determining the characteristics of an exposure to produce the best possible exposure requirements.

Other objects of the present invention will become apparent in the course of the following specification.

In the accomplishment of the objectives of the present invention it was found desirable to provide a function generator which receives a signal corresponding to the X-raying voltage and produces therefrom an outgoing signal operating the setting means for the exposure voltage, and wherein is programmed the shape of the exposure voltage depending upon the X-raying voltage.

In the X-ray diagnosis apparatus of the present invention there is no direct taking over of the set X-raying voltage as the exposure voltage, as is the case in prior art, but each exposure voltage corresponding to each X-raying voltage is determined by the function generator. The function generator can be programmed corresponding to the desires of the use, namely, the shape of the exposure voltage can be fixed depending upon specific criteria, for example, the optimum contrast or the minimum exposure time period.

According to a further advantageous embodiment of the present invention several programs are fed into the function generator, which can be selected manually. According to this embodiment the user can select the best possible program for specific requirements corresponding to the examination of a specific patient. Only a single setting step is required for this purpose, so that an individual setting of exposure voltage for each exposure or exposure series is eliminated.

The programs can be adapted to the individual body parts or organs and can be selected by functional keys at a serving desk. In that case the user by pressing a key can select in a simple manner the required program for examining a patient. No further setting is necessary during examination.

The invention will appear more clearly from the following detailed description when taken in connection with the accompanying drawings showing by way of example only, preferred embodiments of the inventive idea.

In the drawings

Figure 1:
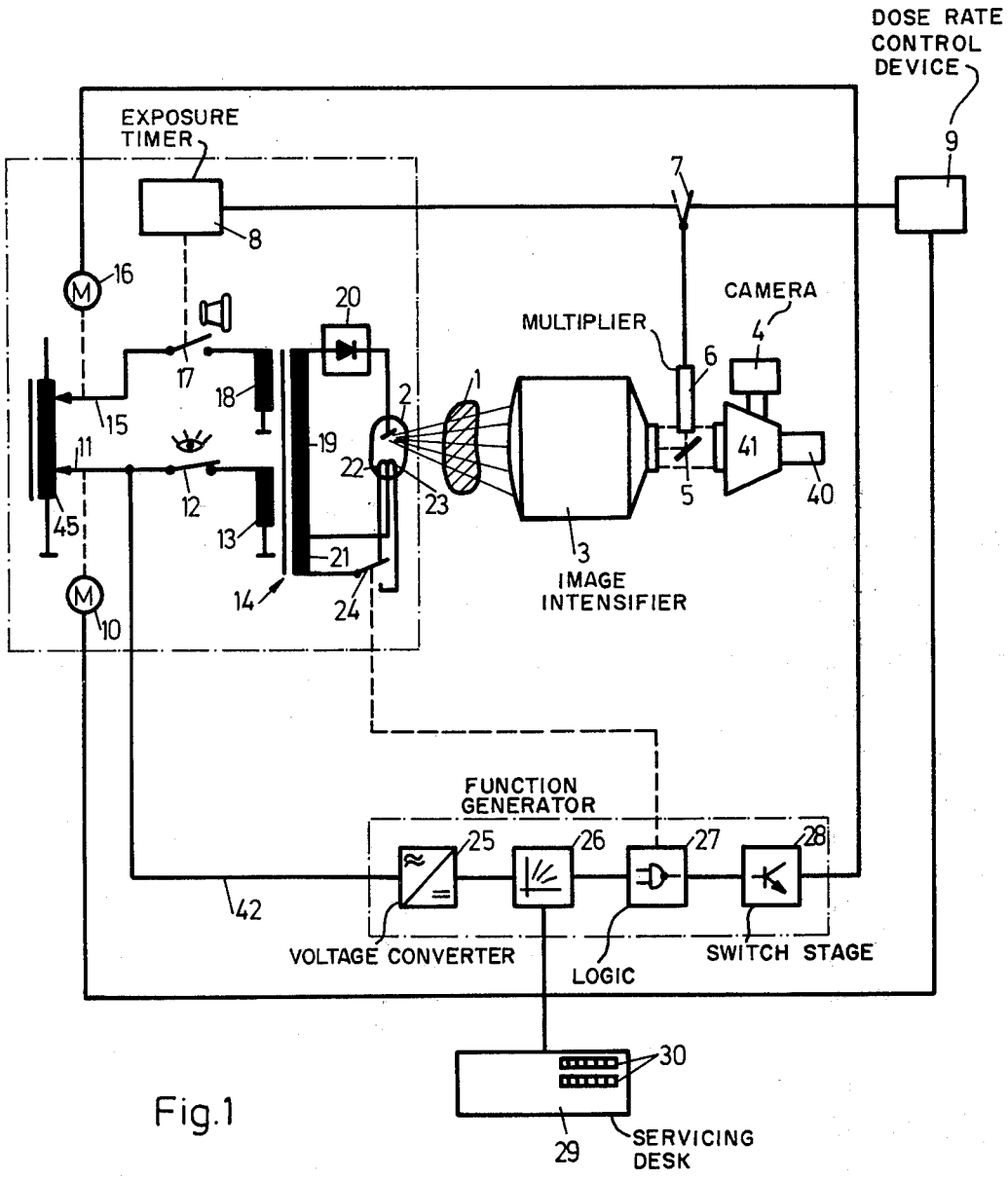
FIG. 1 is a circuit diagram of an X-ray diagnosis apparatus of the present invention.

Referring to FIG. 1, an X-ray tube 2 transmits rays through a patient 1 illustrated diagrammatically in section. Images produced by the X-ray tube 2 are transmitted by an image intensifier 3 to a television camera 40 and a camera 4 for producing series of exposures. A mirror 5 is located between the output screen of the image intensifier 3 and the optical separating device 41. The mirror 5 transmits to a multiplier 6 a signal corresponding to the brightness upon the output screen of the image intensifier 3. The multiplier 6 can be selectively connected by a switch 7 to an automatic exposure time 8 or to dose rate control device 9.

The dose rate control device 9 actuates by its outgoing signal a control motor 10 for the reading key 11 of a control transformer 45. The key 11 determines the X-raying voltage which is transmitted by a switch 12 closed during X-raying to the primary winding 13 of a high voltage transformer 14. The setting of the exposure voltage takes place by a key 15 which is movable by a control motor 16. The exposure voltage is transmitted through a switch 17 which is closed during exposure, to a primary winding 18 of the high voltage transformer 14. The X-ray tube 2 is fed with high voltage from a secondary winding 19 through a high voltage rectifier 20. A secondary winding 21 of the high voltage transformer 14 feeds selectively two heating filaments 22 and 23 of the X-ray tube 2 having two different focuses. The selection of the desired heating filament 22 or 23 takes place by a switch 24.

A signal corresponding to the prevailing X-raying voltage is transmitted to a voltage converter 25 through a conduit 42. The converter 25 operates a function generator 26 which produces an output signal depending upon the input signal according to a predetermined program, namely, upon the shape of the exposure voltage in dependence of the X-raying voltage. The output signal of the generator 26 operates through a logic 27 a switch stage 28 which switches on and off the motor 16 to set the exposure voltage. The device 27 also causes the switching of the switch 24, namely, the selection of the focus of the X-ray tube 2.

The X-ray diagnosis apparatus shown in FIG. 1 is provided with a servicing desk 29 carrying operational keys 30. The keys 30 make possible the selection of a program in the generator 26 while the exposure voltage is dependent from the X-raying voltage.

During X-raying the switches 17 and 12 assume their positions shown in full lines. The dose rate control device 9 sets the position of the key 11 and thus of the X-ray tube voltage and current in such manner that the brightness upon the output light screen of the image intensifier 3 remains constant. As already stated, the function generator 26 receives from the voltage converter 25 a signal corresponding to the prevailing X-raying voltage. The user selects through keys 30 which organ or part of the body is to be photographed by the camera 4, namely, the keys 30 select the desired program in the function generator 26 after the exposure voltage has been made dependent upon the X-raying voltage. When the operation is to proceed from X-raying to exposure, then the switch 12 is opened and the switch 17 is closed. The exposure voltage has been set already during X-raying by the motor 16 corresponding to the desired program, so that when the switch 17 is closed the correct voltage is already provided at the X-ray tube 2 for making a series of exposures with the camera 4. The correct focus of the X-ray tube 2 is also selected by the logic 27 corresponding to the pressed key 30, namely, the correct filament 22 or 23 is switched on to the secondary winding 21. Thus the illustrated X-ray diagnosis apparatus of the present invention is switched over directly from illumination to photographing without it being necessary to separately set the exposure voltage. The desired program according to which the exposure voltage is to depend from X-raying voltage, can be selected by keys 30 prior to or during X-raying.

During exposure the switch 7 is also moved into the position shown by broken lines in which the automatic exposure timer 8 receives from the multiplier 6 a signal corresponding to the dose output according to patient 1. The automatic exposure timer causes the opening of the switch 17 and thus the end of an exposure when the dose required for the best image blackening has been reached.

The two keys 11 and 13 feed two separated primary windings 13 and 18 of the high-voltage transformer 14. The primary winding 13 is switched on when fluoroscopy takes place. The terms "fluoroscopy" and "X-raying" are both used to designate the procedure wherein an image taken by the television camera 40 is observed by the image screen of a television viewing device. During this fluoroscoping procedure, the brightness upon the outgoing screen of the image intensifier 3 and thus the brightness of the reproduced image remain constant in the described manner.

The primary winding 18 is switched on when an X-ray photograph is to be produced by the camera 4. The switching of this photographing takes place through the illumination automat 8. This photographing is connected with a fluoroscopy, namely, with the viewing of an X-ray picture by an observer. Only one of the two primary windings 13 and 18 is always switched on by the switches 12 and 17. The switch 12 is closed during a fluoroscoping, and the switch 17 is closed during a photographing.

As already stated, the fluoroscopy voltage is automatically so set by the motor 10 that the brightness at the X-ray picture intensifier 3 remains constant. However, during photographing, the regulating device for brightness is inoperative, since, then, the switch 7 is switched into the position shown by broken lines in the drawing. The X-ray tube voltage for photographing is set by the motor 16, depending upon the selected program of the function generator 26. Besides the selected program, this voltage also depends upon the fluoroscopy voltage. In this manner, it is possible to obtain the best possible photographing voltage which produces the best possible picture. As is known, the quality of a picture depends upon the X-ray tube voltage, since the image contrast diminishes with increased X-ray tube voltage. The photographing voltage is constant during the entire photographing, since the photographing is switched on by the illumination automat 8 when there is the best image blackening.

Figure 2:
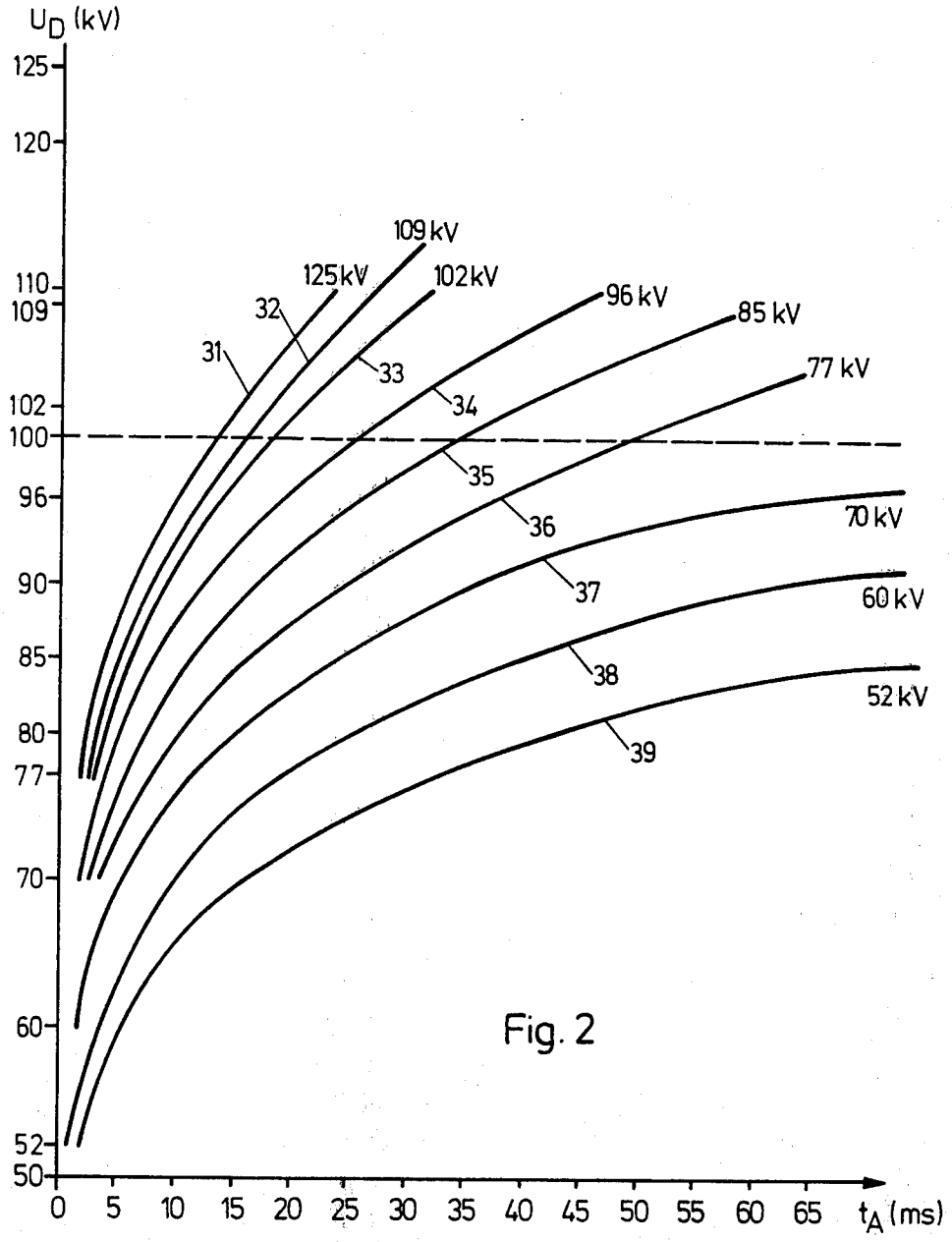
FIG. 2 is a diagram showing curves determining the photographing time depending on illumination voltage and photographing voltage.

FIG. 2 illustrates conditions upon which the X-ray diagnosis apparatus of FIG. 1 is based. FIG. 2 shows curves 31 to 39 illustrating the extent of the exposure time period $t_A$ depending upon the X-raying voltage $U_D$ for different exposure voltages. If, for example, the illumination voltage set by the motor 10 is 100 kV, then as shown by the broken line of FIG. 2 for an exposure voltage of 125 kV an exposure time period of about 13 msec. is produced, while an exposure voltage of 77 kV causes an exposure time period of about 48 msec. FIG. 2 shows how the function generator 26 must be programmed corresponding to the different requirements. If, for example, a smallest photographing time period is desired, then the programming of the function generator must take place from this standpoint, namely, the highest possible exposure voltage must be set. On the other hand, if, for example, a good contrast is desired, while the photographing time period is of less importance, then the lowest possible exposure voltage must be provided for the X-raying voltage.

As already stated, the illustration of FIG. 1 is based on the fact that different programs have been fed to the function generator 26 wherein the exposure voltage depends upon the X-raying voltage and wherein the selection of the desired program takes place through keys 30 which are the functioning keys. Thus each key 30 pertains to a specific body part or organ and the corresponding program is adjusted to this body part or organ to be photographed. Therefore, the user must press only once one of the keys 30 for a specific patient and a specific examination to select the program in the function generator 26. The setting of exposure voltage for each exposure or series of exposures then takes place automatically.

It is unimportant for the scope of the present invention whether the camera 4 is to take individual exposures or series of exposures. Of importance is that before the taking of an exposure or a series of exposures, i.e. when going over from X-raying to exposure, the best exposure voltage is applied to the X-ray tube 2 immediately when the switch 12 is opened, the switch 17 is closed and the switch 7 is moved over.

In the embodiment of the present invention shown in FIG. 1, when the keys 30 are pressed, not only is the program selected in the function generator 26, but also at the same time the correct focus of the X-ray tube 2 is produced through the function generator 26 and the device 27 by corresponding switching of the switch 24. Thus the X-ray diagnosis apparatus of the present invention shown in FIG. 1 does not require focus selection.

However, within the framework of the present invention it is possible to eliminate the functional keys 30 if the user is satisfied as being sufficient with a single program wherein the exposure voltage depends upon the X-raying voltage. In that case the function generator 26 is fixedly programmed with this single program. Then no actuation of keys or other operations for fixing exposure voltage are necessary.

It is thus apparent that the present invention makes possible with simple servicing to provide an individual fixing of the extent of exposure voltage depending upon the X-raying voltage. Despite great simplicity in servicing the X-ray diagnosis apparatus of the present invention can be easily adapted to all individual requirements.

Figure 3:
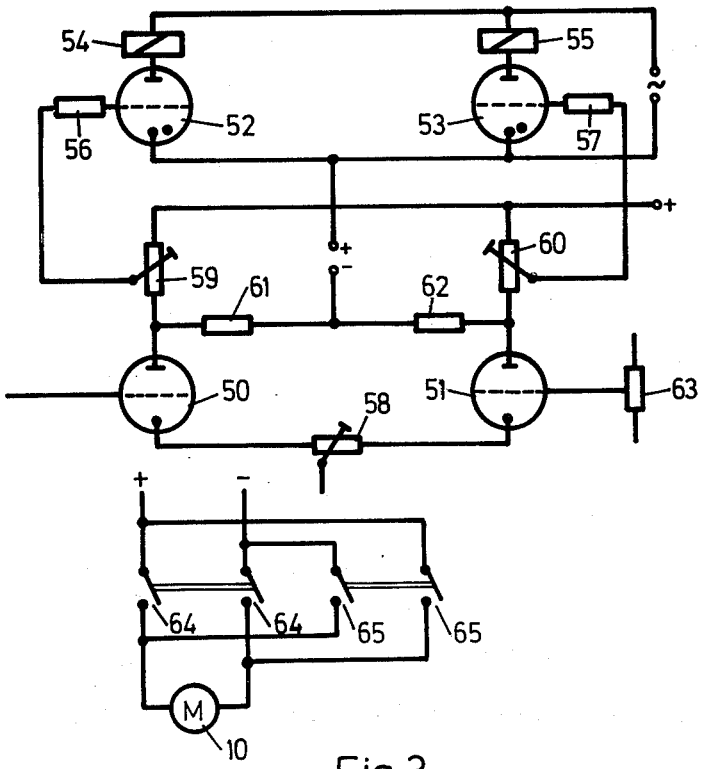
FIG. 3 is a circuit diagram illustrating the structure of the dose rate control device.

An example of the arrangement of the dose rate control device 9 is shown in FIG. 3. The illustrated circuit includes a bridge connection with two control triodes 50 and 51 and two triodes with firing characteristics, for example, thyratrons 52 and 53. The current of the triodes 52 and 53 flows through the windings of two relays 54 and 55. The actuating voltage is supplied by the triodes 52 and 53 through two resistances 56 and 57. The bridge connection is amplified by adjustable resistances 58, 59 and 60 and fixed resistances 61 and 62.

The control grid of the triode 50 receives a signal supplied by the photo-multiplier 6 and corresponding to the image brightness upon the output screen of the image-amplifier 3. The control grid of the triode 51 receives a signal supplied by a rated value producer 63 and corresponding to the rated value of this image brightness. If the brightness at the output screen of the image intensifier 3 increases, then the grid voltage of the triode 50 becomes more negative and the anode current of this triode is lowered. Consequently, the anode voltage is increased and the bridge connection loses its balance. The grid voltage of the triode 52 becomes more positive relatively to the cathode and the triode 52 lights up. The relay 54 is actuated and closes its contacts 64. The motor 10 is thus subject to voltage and shifts the contact 11 until the actual value of brightness again corresponds to the rated value.

If the brightness at the output screen of the image intensifier 3 is decreased, then the grid voltage of the triode 50 changes positively. The anode current of this triode is raised and the anode voltage drops. The bridge connection also gets out of balance. The cathode voltage of the triodes 52 and 53 is changed negatively. The grid of the triode 53 becomes more positive relatively to the other cathode and the triode 53 fires. The relay 55 is attracted and closes its contacts 65. The motor 10 is supplied with direct voltage and again causes a shifting of the contact 11 until the image brightness at the image intensifier output screen is balanced to the rated value, this time, however, in the opposite direction.

Figure 4:
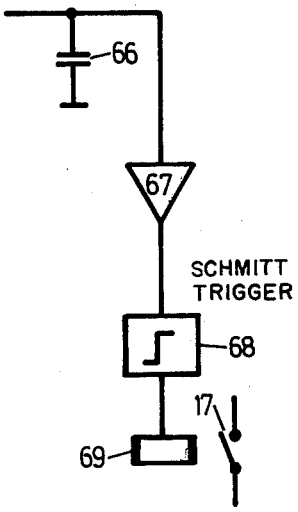
FIG. 4 is a circuit diagram illustrating the connections of an automatic exposure timer.

As shown in FIG. 4, the automatic exposure timer 8 includes an integration condenser 66, a measure amplifier 67 connected thereto, a threshold value member 68, for example, a Schmitt trigger, and a relay 69 with a contact 17. Voltage delivered from the photo multiplier 6 is delivered to the condenser 66 during the taking of an exposure. It integrates this voltage and when a predetermined threshold value is reached which corresponds to the best possible film blackening, threshold value member 68 tips over and produces an attraction in the relay 69, so that, as illustrated, the contact 17 is opened and thus the exposure is ended.

Figure 5:
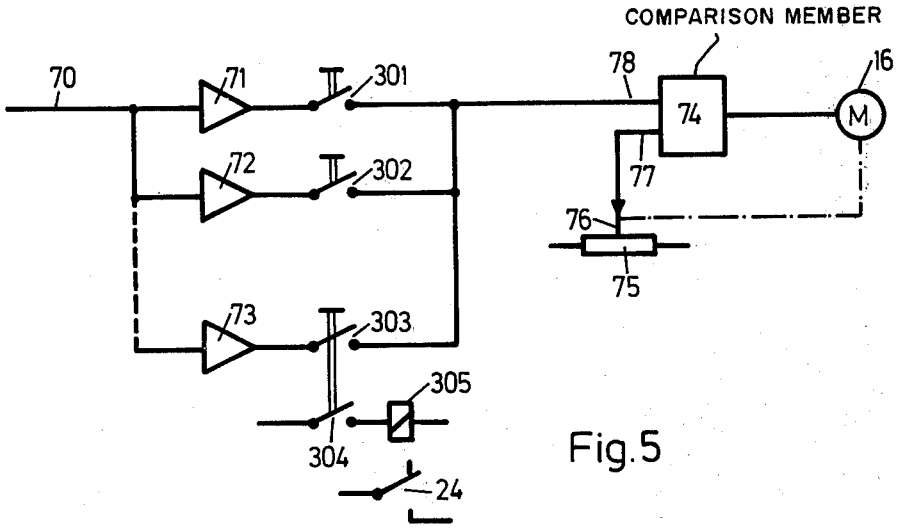
FIG. 5 is a circuit diagram illustrating details of structural elements.

FIG. 5 shows the structural elements 26 to 28 in detail. Direct voltage supplied by the voltage changer 25 and corresponding to the prevailing X-raying voltage is in the conduit 70. This conduit extends parallel to the inputs of a number of amplifiers, the amlifiers 71, 72 and 73 being shown in FIG. 5. Contacts 301 to 303 can be selectively closed by the keys 30 of the servicing desk 29. These contacts connect the outputs of amplifiers 71 to 73 to an input of a comparison member 74. The output voltage of the comparison member 74 actuates the motor 16 to set the exposure voltage. The motor 16 along with the comparison member 74 and a setting resistance 75 form a follow-up device, namely it sets the contact 76 of the resistance 74 until the voltage at the input 77 of the comparison member 74 becomes equal to the voltage at the input 78 and thus the output voltage of the comparison member 74 becomes zero.

The amplifiers 71 to 73 have different amplifying characteristics, so that depending upon the pressed key at the servicing desk 29 the voltage at the input 78 of the comparison member 74 depends upon the voltage of the conduit 70, namely, upon the prevailing X-raying voltage. If, for example, the contact 301 is closed, then the characteristic of the amplifier 71 determines the extent of the voltage at the input 78 depending upon the X-raying voltage. The motor 16 sets the contact 15 at a location which corresponds to this voltage. Due to the different amplifying characteristics of the amplifiers 71 to 73 these locations are also different for a specific X-raying voltage, so that different exposure voltages result. The characteristics in accordance with which the exposure voltage can depend from the X-raying voltage, correspond to the amplifying characteristics of the amplifiers 71 to 73.

In the example shown in FIG. 5 the device 27 consists of a contact 304 operated jointly with the contact 303 and a relay 305. When the contact 303 is closed, i.e. when the amplifier 73 is selected for determining the dependency of the exposure voltage from the X-raying voltage, then at the same time the contact 304 is closed and the relay 305 is excited. The relay 305 causes the switching over of the contact 24 and thus the selections of the second focus. Thus according to the example of FIG. 5 operation with one focus of the X-ray tube 2 takes place when one of the amplifiers 71 and 72 is selected and the operation of the other focus of the X-ray tube 2 takes place when the amplifier 73 is selected.

Within the framework of the present invention more than three amplifiers or only two amplifiers can be used for determining the program, the exposure voltage being dependent upon the X-raying voltage. The amplifying characteristic can be such that the exposure voltage depends upon the X-raying voltage linearly or according to a predetermined curve.

What is claimed is:

1. An X-ray diagnosis apparatus for fluoroscopy and exposure, comprising in combination an X-ray tube adapted to X-ray a patient, a power supply supplying said X-ray tube, an image intensifier receiving the rays of said tube and transmitting the images produced by the X-rays, to a television camera connected with said intensifier and a photographing camera connected with said intensifier, a device for dose rate control during fluoroscopy, said device comprising means for varying the fluoroscopy voltage and current of the X-ray tube in such a manner that the brightness upon the output screen of the intensifier remains constant, setting means for the exposure voltage at the X-ray tube, an automatic exposure timer for causing the end of an exposure when the dose required for the best image blackening has been reached, a function generator and means connecting said function generator with said power supply and transmitting thereto a signal corresponding to the prevailing fluoroscopy voltage, said function generator forming an outgoing signal actuating the setting means for the exposure voltage, the shape of the exposure voltage depending upon the fluoroscopy voltage being programmed in the function generator.

2. An apparatus according to claim 1, wherein several manually selectable programs are stored in said function generator.

3. An apparatus according to claim 2, comprising a servicing desk and a plurality of functional keys carried by said desk and connected with said function generator, the programs of said function generator corresponding to individual parts and organs of a body and being selectable by said functional keys.

* * * * *